US005152030A

United States Patent [19]

Cogo

[11] Patent Number: 5,152,030

[45] Date of Patent: Oct. 6, 1992

[54] VEHICLE DOOR CHECK

[75] Inventor: Ronald J. Cogo, Northville, Mich.

[73] Assignee: Thunderline Corporation, Belleville, Mich.

[21] Appl. No.: 580,565

[22] Filed: Sep. 11, 1990

[51] Int. Cl.[5] ..... E05F 5/06; E05D 11/10

[52] U.S. Cl. ..... 16/86 C; 16/344; 16/DIG. 21

[58] Field of Search ..... 16/82, 85, 86 A, 86 B, 16/86 C, 86 R, 325, 332, 333, 334, 335, 344, 345, 347, DIG. 10, DIG. 17, DIG. 21; 292/14, 15, 16, 17

[56] References Cited

U.S. PATENT DOCUMENTS

| | | | |
|---|---|---|---|
| 1,089,193 | 3/1914 | Ervien | 16/86 B |
| 1,910,372 | 5/1933 | Thomas | 16/86 B |
| 2,032,600 | 3/1936 | Smith | 16/86 C |
| 2,039,960 | 5/1936 | Jacobs . | |
| 2,074,398 | 3/1937 | Jacobs . | |
| 2,140,958 | 12/1938 | Jacobs . | |
| 2,290,331 | 7/1942 | Jacobs | 16/86 C |
| 2,523,088 | 9/1950 | Beyer . | |
| 2,882,548 | 4/1959 | Roethel . | |
| 2,915,779 | 12/1959 | Allen . | |
| 2,979,355 | 4/1961 | Brown . | |
| 2,980,945 | 4/1961 | Hollar . | |
| 3,012,269 | 12/1961 | Bartel | 16/86 A |
| 3,065,497 | 11/1927 | Faber . | |
| 3,224,033 | 12/1965 | Fannan et al. . | |
| 3,224,034 | 12/1965 | Fannan et al. . | |
| 3,230,576 | 1/1966 | Sauer . | |
| 3,369,833 | 2/1968 | Schaldenbrand . | |
| 3,550,185 | 12/1970 | Marchione . | |
| 3,710,417 | 1/1973 | Berman et al. . | |
| 3,905,064 | 9/1975 | Brockhaus . | |
| 3,911,529 | 10/1975 | Pringle . | |
| 3,969,789 | 7/1976 | Wize . | |
| 4,266,321 | 5/1981 | Pelchat et al. . | |
| 4,532,675 | 8/1985 | Salazar . | |
| 4,720,895 | 1/1988 | Peebles . | |
| 4,794,669 | 1/1989 | Sanders . | |
| 4,800,624 | 1/1989 | Whitefoot et al. | 16/86 A |
| 4,833,755 | 5/1989 | Bonin | 16/86 A |

FOREIGN PATENT DOCUMENTS

| | | | |
|---|---|---|---|
| 165693 | 12/1985 | European Pat. Off. . | |
| 1915750 | 10/1970 | Fed. Rep. of Germany . | |
| 2123536 | 12/1972 | Fed. Rep. of Germany . | |
| 2406906 | 8/1975 | Fed. Rep. of Germany . | |
| 2415887 | 10/1975 | Fed. Rep. of Germany | 16/86 R |
| 2284740 | 4/1976 | France . | |
| 2592913 | 7/1987 | France . | |

*Primary Examiner*—Lowell A. Larson
*Assistant Examiner*—Thomas C. Schoeffler
*Attorney, Agent, or Firm*—Kinzer, Plyer, Dorn, McEachran & Jambor

[57] ABSTRACT

A door check for controlling pivotal movement of a vehicle door between a closed position and one or more open positions, sometimes incorporated in a hinge, includes a rigid, elongated track member having two opposed track surfaces with at least one detent receptacle in one track surface or in both track surfaces. A roller detent member engages one track surface in rolling pressure contact at least part of the time whenever the door moves between its open and closed positions; a second detent member, comprising a sliding, self-aligning, non-rotational bearing, engages the other track surface. Both detent members are formed of a fiber reinforced resin, such as a glass fiber reinforced nylon. The second detent member is urged toward one track surface by an elastomer pad, preferably an elastomer such as a silicone polymer that retains its elastic properties over a wide temperature range that extends beyond the temperatures of manufacturing processes or human environments.

10 Claims, 2 Drawing Sheets

FIG. 1
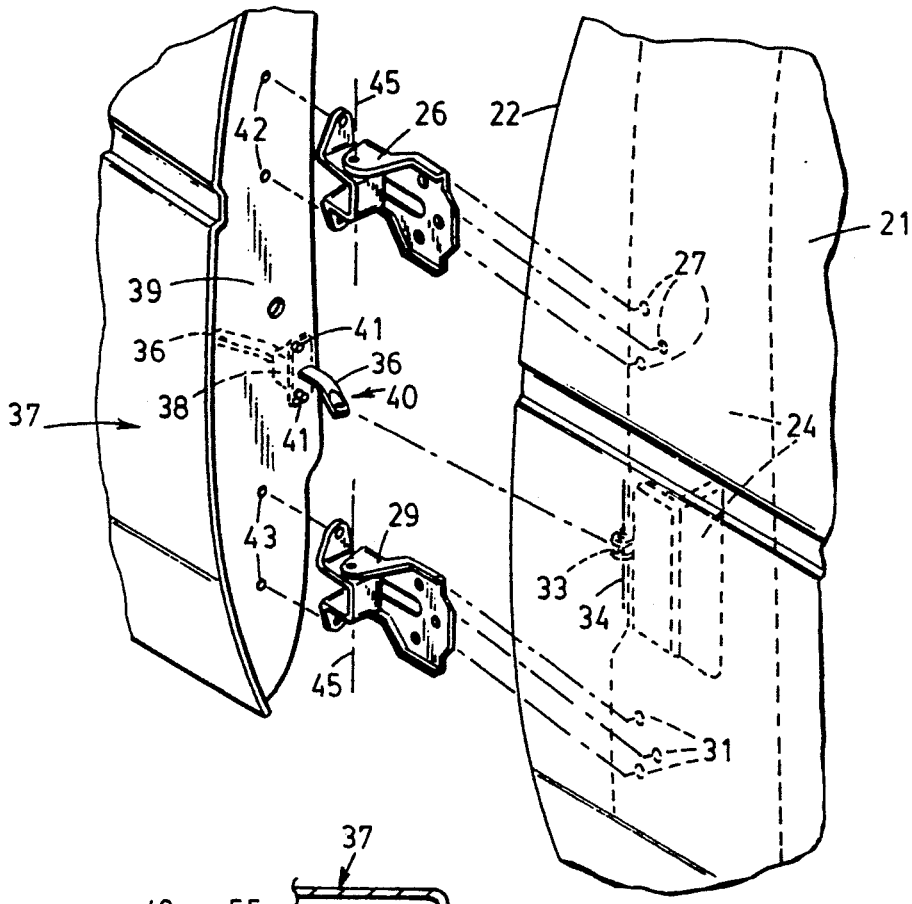
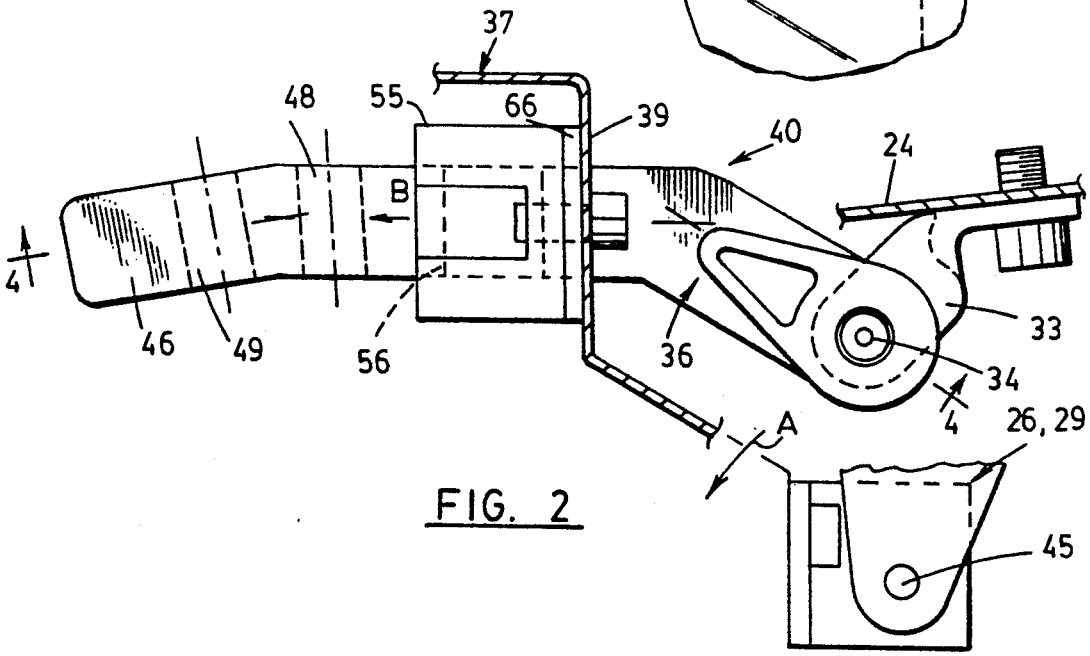
FIG. 2

FIG. 3
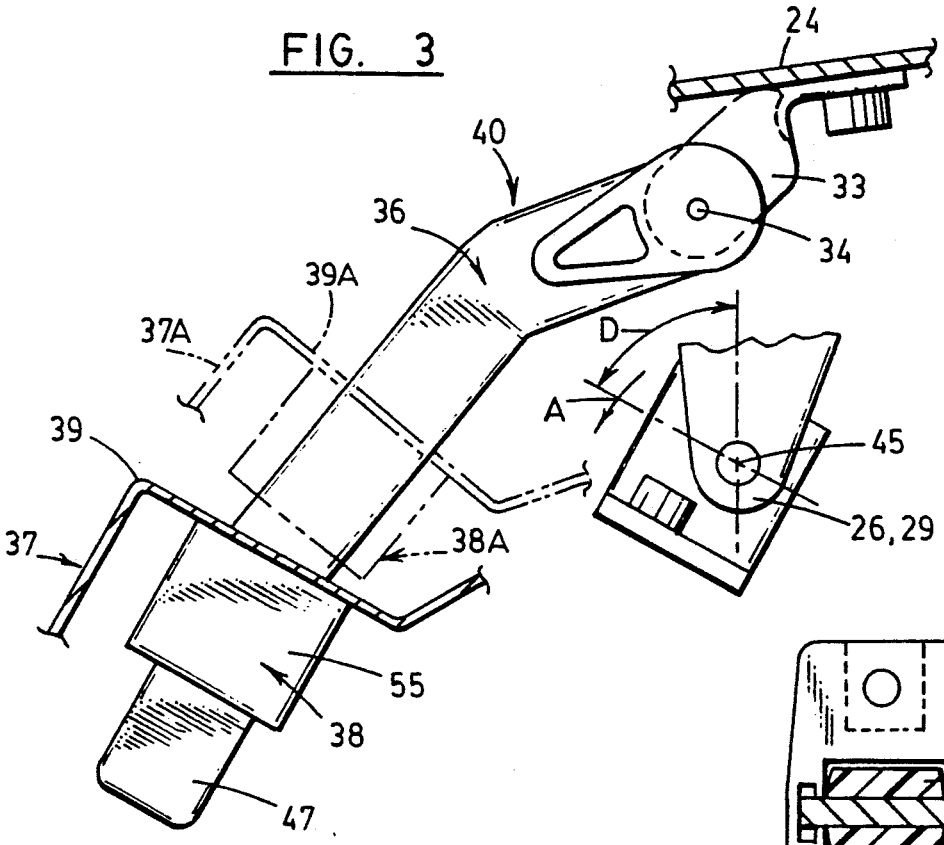
FIG. 5
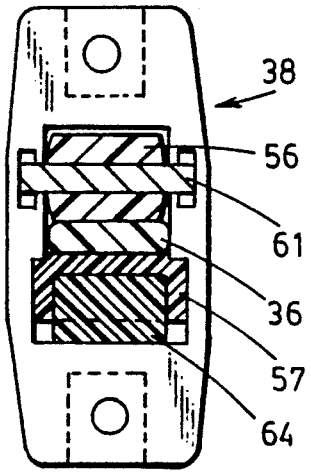
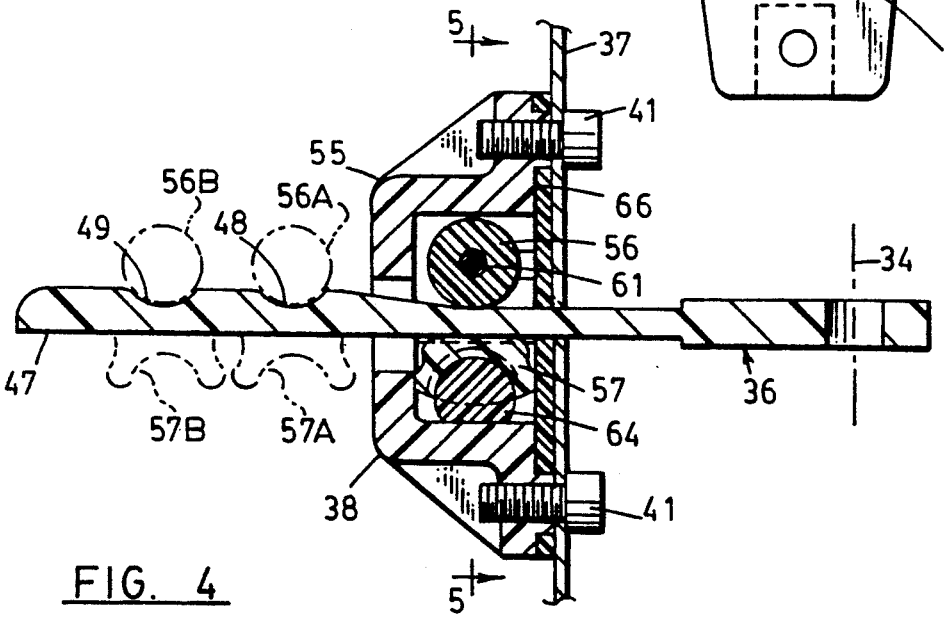
FIG. 4

VEHICLE DOOR CHECK

BACKGROUND OF THE INVENTION

On automobiles, recreational vehicles, vans, small trucks, and virtually all other vehicles, a door check for each vehicle door is usually considered a necessity. The door check often provides two open positions; in one the door is partially open and in the other the door is fully open. Even the full open position may be appreciably less than ninety degrees. In some vehicles the door check provides only one open retention position.

Door checks of this sort are quite common and have been used for many years. However, they are far from uniform in construction or in application. In many vehicles the manufacturer provides a check mechanism that is separate from the door hinges. In this arrangement, particularly in small cars, each door is supported upon two simple hinges that do not establish any retained or detented open positions for the door. In other instances, particularly in larger automobiles, the manufacturer may prefer hinges that incorporate door checks in the hinge structures. Thus, in a typical large car construction, each door is hung from two hinges, and one of those hinges includes a door check establishing two retention or detented positions for holding the door open.

Vehicle door checks have exhibited some substantial difficulties. Thus, the door checks used in automobiles and similar applications, whether separate from or combined with hinges, have frequently required lubrication, without which they tend to squeak and to make other undesirable noises. Some of these door checks only produce noises when opened to full detented open position or beyond. Many of these door checks have an inadequate operating life; they do not last for the full life of the vehicle. Corrosion may also be a substantial problem. In at least some door checks, processing of the vehicle body after installation of the doors, particularly in the curing of external finishes, may require temperatures well beyond the tolerance range of materials used in the door check mechanisms. Thus, it is not uncommon for a vehicle body to be subjected, at least for a brief interval, to temperatures up to near 400° F. after the door installations are completed. This may result in appreciable damage to a door check, whether incorporated in or separate from a door hinge, and may even require replacement of the door check.

SUMMARY OF THE INVENTION

It is a primary object of the invention, therefore, to provide a new and improved door check for regulating movements of a vehicle door, which provides positive retention of the vehicle door in one or in either of two defined open positions without interfering with opening and closing movements of the doors, yet exhibits long life and is essentially unaffected by very high temperatures and by quite low temperatures.

A further object of the invention is to provide a new and improved door check for a vehicle door that affords an extended operating life without requiring lubrication, yet is simple and relatively inexpensive in construction and in operation.

Accordingly, the invention relates to a door check for controlling pivotal movement of a vehicle door that is pivotally mounted on a first support element comprising part of a vehicle frame, between a closed position and an open position that is displaced from the closed position by a predetermined angle, the vehicle door including a second support element. The door check comprises a rigid, non-elastic track member, including two elongated, opposed track surfaces, one track surface having a roller detent receptacle therein, a first detent member comprising a roller, a second detent member comprising a non-rotational self-aligning, sliding, bearing, and mounting means for mounting the track member on one of the support elements and for mounting the detent members on the other of the support elements on opposite sides of the track member with the first detent member aligned with the one track surface. One of the detent members has a resilient, distortable construction afforded by a resilient elastomer material. The mounting means and the resilient distortable construction of the one detent member conjointly maintain the first detent member in pressure rolling engagement with the one track surface and maintain the second detent member in sliding contact with the other track surface during at least a portion of the movement of the door between its closed and open positions. The alignment of the first detent member and the track surface cause the first detent member to engage in the detent receptacle when the door is pivoted to its open position so that the two detent members and the track member releasably maintain the door in its open position.

BRIEF DESCRIPTION OF THE DRAWINGS

FIG. 1 is a partially exploded perspective view of a vehicle door mounting, employed to describe and illustrate use of a door check;

FIG. 2 is a partially sectional plan view of a vehicle door check mechanism constructed in accordance with one embodiment of the invention, with the door closed;

FIG. 3 is a plan view like FIG. 2 but with the door fully open;

FIG. 4 is a detail view, in cross section, taken approximately as indicated by line 4—4 in FIG. 2; and FIG. 5 is a detail sectional view, partly in cross section, taken approximately as indicated by line 5—5 in FIG. 4.

DESCRIPTION OF THE PREFERRED EMBODIMENT

FIG. 1 affords a partially exploded perspective view of a portion of the side of a vehicle, including a part of a door opening. At the right-hand side of FIG. 1 a portion of the right front side body of the vehicle is shown. This could be an automobile, a small or large truck, or virtually any other kind of vehicle. The edge of the door opening, along the left-hand vertical side of body member 21, is identified by reference numeral 22. Closely adjacent to it there is a vertical frame member 24, a part of the vehicle frame.

The door arrangement shown in FIG. 1 includes an upper hinge 26 that includes appropriate provisions for mounting on the vertical frame member 24 at three mounting locations 27. Similarly, there is a second, lower hinge 29 that is fastened to the vertical frame member 24 at plural locations such as the locations 31. In addition, a clevis 33 is shown mounted on the vertical frame member 24. Clevis 33 has a vertical axis 34. The clevis is a part of a door check 40 comprising an embodiment of the present invention, described more fully in connection with FIGS. 2-5. The clevis affords a pivotal connection for an elongated track member 36 that projects outwardly from frame member 24 and clevis 33 toward a door 37. Track member 36 extends through a guide device 38 that is mounted on door 37.

Door 37 includes a vertical support member 39 that is an integral part of the door. Guide device 38 is mounted on support member 39 by a plurality of appropriate fasteners 41. Clevis 33, track member 36, and guide device 38 all are part of door check 40. Of course, upper hinge 26 is mounted on door 37, preferably as indicated at points 42 on support member 39. Similarly, lower hinge 29 is secured to the vertical support member 39 of door 37 at appropriate locations 43. The two hinges 26 and 29, in an accurately installed door, should have a common pivotal axis 45, the axis for pivotal movement of the door.

In the preferred form of door check 40 shown in FIGS. 2–4, track member 36 has two opposed track surfaces 46 and 47, both surfaces appearing in FIG. 4. As best seen in FIG. 4, there are two depressions or detent receptacles 48 and 49 in the one track surface 46. There are no detent receptacles in the other track surface 47. The number and distribution of the detent receptacles in track surface 46 is determined by the number of retention positions desired for door 37 when opened away from body 21 (FIG. 1) and also by the number of detent rollers used in the mechanism.

The construction of guide device 38 for door check 40 may best be understood from FIGS. 2–5. Guide device 38 includes an external housing 55 preferably molded of a relatively strong resin such as glass-reinforced nylon. Housing 55 is mounted upon door support element 39 by bolts or other fasteners 41; see FIG. 4. The configuration of housing 55, which may include a base 66, is not particularly critical. The housing does provide a firm mounting for a first detent member comprising a roller 56 and a self-aligning sliding bearing comprising a second detent member 57. The detent roller member 56 engages track surface 46 of track member 36. The detent member comprising the self-aligning sliding bearing 57 engages the other track surface 47 of member 36. Detent roller 56, as shown in detail in FIG. 5, may comprise a central shaft 61 on which the roller is journalled. Shaft 61 may be formed from ordinary steel rod stock. Roller 56 may be of a molded plastic, such as a glass fiber reinforced resin (e.g., nylon).

The second detent member 57 is a generally cup-shaped retainer, preferably molded from a strong, rigid, durable plastic such as glass fiber reinforced nylon. Another appropriate material is an aramid fiber filled PTFE resin. It is supported on a resilient elastomer pad 64 that also urges member 57 toward surface 47 of track member 36. Preferably, pad 64 is formed of a resilient elastomer material that is capable of retaining its resiliency over a broad range of temperatures, temperatures far beyond those likely to be encountered in any vehicle usage and, indeed, substantially beyond any that might be tolerated by human beings. Thus, the elastomer used for pad 64 should retain its elastic, resilient properties at temperatures well below 0° F. and at temperatures exceeding 400° F., the latter requirement being based on temperatures used in curing vehicle finishes. Silicone polymer rubbers (polydimethylsiloxane)are preferred for the resilient pad 64 of detent member 57.

In explaining the operation of vehicle door check mechanism 40, it is most convenient to start from the closed position of door 37, as illustrated in FIGS. 2 and 4. In those views, detent members 56 and 57 are shown engaged with track surfaces 46 and 47 of track member 36 (FIG. 4). However, this is not essential; for the closed position of door 37, the detent members could be spaced from the track surfaces.

To open door 37, the door latch (not shown) is released and the door is pivoted toward an open position with respect to car body 21 and particularly its frame member 24. The direction of this movement is counterclockwise about hinge axis 45, viewed from above, as indicated by the arrow A in FIG. 2. This pivotal movement of the door drives guide device 38 along track member 36, in the direction generally indicated by the arrows B in FIGS. 2 and 4, and compels track member 36 to pivot, again in a counterclockwise direction, about axis 34 of clevis 33. This movement continues, as the door proceeds in its pivotal opening movement, until the detent roller member 56 comes into alignment with the first receptacle 48 in track surfaces 46 of member 36. At this point the detent roller 56, which has been driven a short distance away from the bearing detent member 57, 64 by the thickness of the track member 36 that they are traversing, drops into detent receptacle 48, seating there as indicated generally by the phantom outline 56A in FIG. 4. See also outline 57A. If this position 37A (FIG. 3) is as far as the vehicle user wants to open door 37, roller 56 remains engaged in receptacle 48 and the door is held firmly in a partially open position; the door support member 39 is a position 39A, FIG. 3. In a typical automotive vehicle, this might be an opening angle of about 30° to 40° for the door. In general, the position for guide device 38 on track member 36, for this initial open position of the door, is indicated by the phantom outline 38A in FIG. 3.

Additional impetus can be applied to door 37 to swing it further open, as to the full open position shown in solid lines in FIG. 3. To this end, the door is pivoted further in the clockwise direction of arrow A; members 56 and 57 ride along track surfaces 46 and 47 of member 36 until roller 56 comes into engagement with the outer detent roller receptacle 49, reaching the position shown in FIG. 3. For this full open door position, with the detents in the positions 56B and 57B, FIG. 4, the total pivotal movement of door 37, angle D, FIG. 3, may be about 60°. For the full open door position, as in the intermediate open position defined by detent receptacle 48, the vehicle door is held firmly in the desired open position, allowing egress and ingress of people and objects from and into the vehicle.

To close door 37, of course, it is pivoted back toward body 21 and fixed frame member 24 (FIG. 1), reversing the previously described movements. That is, the door is driven back clockwise in a direction opposite to arrow A (FIG. 2), through angle D (FIG. 3) so that guide device 38 rides back along track member 36 in a direction opposite to arrows B (FIGS. 2 and 4) and the track member itself is again pivoted, in a clockwise direction, from the position of FIG. 3 back toward that of FIG. 2. On the return motion, if desired, door 37 can again be stopped and held at the intermediate position defined by detent roller receptacle 48, FIG. 4. On the other hand, if it is desired to close the door completely, it is pivoted back to the original position shown in FIGS. 2 and 4.

I claim:

1. A door check for controlling pivotal movement of a vehicle door, pivotally mounted on a first support element comprising part of a vehicle frame, between a closed position and an open position that is displaced from the closed position by a predetermined angle, the vehicle door including a second support element, the door check comprising:

a rigid, non-elastic track member, including two elongated, opposed track surfaces, one track surface having a roller detent receptacle therein;

a first detent member, comprising a roller;

a second detent member, comprising a non-rotational, self-aligning sliding bearing;

mounting means for mounting the track member on one of the support elements and for mounting the detent members on the other of the support elements on opposite sides of the track member with the first detent member aligned with the one track surface;

the second detent member having a resilient distortable construction afforded by a resilient elastomer material;

the mounting means and the resilient distortable construction of the second detent member conjointly maintaining the first detent member in pressure rolling engagement with the one track surface and maintaining the second detent member in sliding contact with the other track surface during at least a portion of the movement of the door between its closed and open positions; and the alignment of the first detent member and the one track surface causing the first detent member to engage in the detent receptacle when the door is pivoted to its open position so that the two detent members and the track member releasably maintain the door in its open position.

2. A door check according to claim 1 in which the elastomer material retains its resiliency and elasticity even though subjected to elevated temperatures of the order of 400° F.

3. A door check according to claim 1 in which the second detent member comprises a rigid cup-shaped retainer mounted on a resilient pad of elastomer material.

4. A door check according to claim 3 in which the elastomer material retains its resiliency and elasticity even though subjected to elevated temperatures of the order of 400° F.

5. A door check according to claim 3 in which the cup-shaped retainer is molded from a hard, fiber reinforced resin.

6. A door check according to claim 1 in which the track member is formed of a fiber-reinforced, heat stabilized resin.

7. A door check according to claim 6 in which the resin is nylon and the reinforcing fibers are glass.

8. A door check according to claim 6 in which the second detent member comprises a rigid cup-shaped retainer mounted on a resilient pad of elastomer material.

9. A door check according to claim 8 in which the cup-shaped retainer is molded from a hard, fiber reinforced resin.

10. A door check according to claim 1 in which the door check is incorporated in a door hinge, comprising two hinge members pivotally interconnected by a hinge pin, with the track member mounted on one hinge member and the detent members mounted on the other hinge member, the track member projecting between the detent members, and each hinge member comprising a part of one mounting means.

* * * * *